US008047705B2

(12) United States Patent
Hessler et al.

(10) Patent No.: US 8,047,705 B2
(45) Date of Patent: Nov. 1, 2011

(54) ANTI-SHOCK COLLET

(75) Inventors: Thierry Hessler, Renens (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 227 days.

(21) Appl. No.: 12/279,021

(22) PCT Filed: Feb. 5, 2007

(86) PCT No.: PCT/EP2007/051065

§ 371 (c)(1), (2), (4) Date: Aug. 11, 2008

(87) PCT Pub. No.: WO2007/090806

PCT Pub. Date: Aug. 16, 2007

(65) Prior Publication Data

US 2010/0061192 A1 Mar. 11, 2010

(30) Foreign Application Priority Data

Feb. 9, 2006 (EP) ..... 06002642

(51) Int. Cl.
*G04B 17/04* (2006.01)

(52) U.S. Cl. ..... 368/177; 368/175

(58) Field of Classification Search ..... 368/175–178
See application file for complete search history.

(56) References Cited

U.S. PATENT DOCUMENTS

| | | | | |
|---|---|---|---|---|
| 209,642 | A | 11/1878 | Berlitz et al. | |
| 345,840 | A | 7/1886 | Gribi | |
| 570,394 | A | 10/1896 | Griscom | |
| 2,649,684 | A * | 8/1953 | Dolby | 368/177 |
| 2,842,935 | A * | 7/1958 | Bradley | 368/177 |
| 3,186,157 | A * | 6/1965 | Favret et al. | 368/175 |
| 3,364,673 | A * | 1/1968 | Boult | 368/177 |
| 3,396,450 | A * | 8/1968 | Faehndrich et al. | 29/896.31 |
| 3,686,081 | A | 8/1972 | Butter et al. | |
| 4,084,764 | A | 4/1978 | Mogerlein et al. | |
| 4,571,661 | A | 2/1986 | Hoshino | |
| 4,595,184 | A | 6/1986 | Bohm et al. | |
| 4,661,212 | A | 4/1987 | Ehrfeld et al. | |
| 4,990,827 | A | 2/1991 | Ehrfeld et al. | |

(Continued)

FOREIGN PATENT DOCUMENTS

| | | |
|---|---|---|
| CH | 12 491/66 | 10/1968 |

(Continued)

OTHER PUBLICATIONS

International Search Report issued in corresponding application No. PCT/EP2007/051065, completed May 15, 2007 and mailed May 29, 2007.

(Continued)

*Primary Examiner* — Sean Kayes

(74) *Attorney, Agent, or Firm* — Griffin & Szipl, P.C.

(57) ABSTRACT

The collet, which can be made in a single piece and at the same time as the balance-spring, is formed by a plate (1) which includes an aperture (3) for attachment to a balance staff (5) and has an asymmetrical contour (9) which follows at a substantially constant distance d the contour of the first coil (11) of the inner terminal curve. The plate can further include recesses (13) for repositioning the centre of gravity g on the balance staff (5).

9 Claims, 2 Drawing Sheets

U.S. PATENT DOCUMENTS

| | | | | |
|---|---|---|---|---|
| 5,576,250 | A | 11/1996 | Diem et al. | |
| 5,747,743 | A | 5/1998 | Kato et al. | |
| 7,018,092 | B2 * | 3/2006 | Muller | 368/140 |
| 7,077,562 | B2 | 7/2006 | Bourgeois et al. | |
| 7,229,208 | B2 | 6/2007 | Verardo et al. | |
| 2001/0038803 | A1 | 11/2001 | Morales | |
| 2002/0115016 | A1 | 8/2002 | Warren | |
| 2005/0068852 | A1 * | 3/2005 | Hessler et al. | 368/139 |
| 2006/0055097 | A1 | 3/2006 | Conus et al. | |
| 2009/0135679 | A1 * | 5/2009 | Musy et al. | 368/177 |

FOREIGN PATENT DOCUMENTS

| | | | |
|---|---|---|---|
| DE | 2417777 | A | 10/1975 |
| EP | 1 256 854 | A | 11/2002 |
| EP | 1 422 436 | A1 | 5/2004 |
| EP | 1 431 844 | A1 | 6/2004 |
| FR | 1.274.100 | | 9/1961 |
| FR | 1.546.209 | | 11/1968 |
| GB | 1 020 456 | | 2/1966 |
| GB | 1 080 068 | | 8/1967 |
| JP | 1-303333 | A | 12/1989 |

OTHER PUBLICATIONS

European Search Report issued in corresponding application EP 06 00 2642, completed Dec. 4, 2006.

Harendt, Christine et al., "Wafer bonding and its application to silicon-on-insulator fabrication," Technical Digest, MME '90, Micromechanics Europe 1990, Nov. 1990, pp. 81-86.

Webster's New Collegiate Dictionary, 1977, p. 1227.

The Illustrated Science and Invention Encyclopedia 2190-2191, H.S. Stuttman Co., Inc., 1977.

Illustrated Professional Dictionary of Horology I + II 609 (2002).

Hans C. Ohanian, Physics 135, 136 and 341-343 (W.W. Norton & Company, Inc. 1985).

Charles-Andre Reymondin et al., The Theory of Horology 138 and 139 (The Technical College of the Vallee de Joux 2003).

* cited by examiner

ANTI-SHOCK COLLET

This is a National Phase Application in the United States of International Patent Application No. PCT/EP2007/051065 filed Feb. 5, 2007, which claims priority on European Patent Application No. 06002642.4, filed Feb. 9, 2006. The entire disclosures of the above patent applications are hereby incorporated by reference.

FIELD OF THE INVENTION

The present invention concerns a collet, made integral with the balance-spring of a sprung balance regulating system of a mechanical timepiece movement, and whose form has been studied to minimise the risk of breakage at the collet-balance-spring junction region or join in the event of a shock.

BACKGROUND OF THE INVENTION

In a mechanical timepiece movement, the sprung balance regulating system forms one of the most fragile parts of the mechanism, particularly in the event of shocks that can break the pivot-shanks of the balance staff, or even break the balance-spring at the collet-balance-spring join. In order to avoid this risk to the balance staff, the solution that has been proposed for a long time consists in providing shock absorber bearings, such as the "Incabloc" bearing. Such shock absorber bearings also contribute to protecting the balance-spring, but are insufficient when a shock causes a large travel or deflection of the balance-spring and creates tension at the collet-curve join inside the balance-spring. The risk of breakage at this join is greater when the inner terminal curve is of the Grossmann type with a collet of circular contour, i.e. when the first coil of the inner terminal curve has a larger pitch than that of the following coils, meaning that the space between the first coil and the collet is relatively large. The risk of breakage is further increased when the balance-spring is made of a brittle material, such as silicon, monocrystalline quartz or glass, and/or it is made in a single piece at the same time as the collet by micro-machining techniques or photolithography and galvanic growth, as disclosed in EP Patent No. 1 445 670.

SUMMARY OF THE INVENTION

It is thus an object of the present invention to overcome the drawbacks of the aforecited prior art by providing, for a sprung balance regulating system, a collet whose particular contour minimises the risk of breakage at the collet-balance-spring join in the event of violent shocks.

The invention therefore concerns an anti-shock collet formed of a plate including an aperture for attachment to a balance staff of a sprung balance regulating system and means for securing a balance-spring to said collet. Said collet is characterized in that it has a non-circular asymmetrical contour that follows at least from place to place and at a substantially constant small distance d, the contour of the first coil of the inner terminal curve.

The contour of the collet may be continuous or scalloped. In the first case, distance d is the distance that separates the first coil from the ends of the teeth of the scallop.

This construction has the advantage of limiting the travel of the first coil during violent shocks, and thereby considerably reducing the risk of breakage at the collet-balance-spring join, particularly when the collet is made of a brittle material sensitive to shocks, which will be more specifically illustrated in the following description by a material such as silicon, quartz or glass.

The collet can be pinned up by any known means such as by a pin or by laser welding. However, according to a preferred embodiment of the invention, the collet and the balance-spring are made in a single piece.

It will be observed that the asymmetric contour of the collet creates an unbalance meaning that the centre of gravity of the collet or the collet-balance-spring assembly does not coincide with the balance axis, which has a negative effect on isochronism. According to another aspect of the invention, in order to overcome this drawback, the plate forming the collet includes recesses, the surfaces and distribution of which are chosen to reposition said centre of gravity on the balance staff. These recesses can also communicate with the driving in aperture in order to give the latter some resilience.

BRIEF DESCRIPTION OF THE DRAWINGS

Other features and advantages of the present invention will appear in the following description of various embodiments, given by way of non-limiting illustration, with reference to the annexed drawings, in which.

DETAILED DESCRIPTION OF THE INVENTION

The following description is given for the preferred embodiment wherein the collet and the balance-spring form a single piece made of the same material. Recent techniques, well known to those skilled in the art allow almost any contour to be made with a high level of precision and with a high aspect ratio. If the material used is a metal or alloy, the photolithography and electroforming technique will be used. If the material used is an amorphous or crystalline material, such as glass, quartz or silicon, a micro-machining method, already used for example in the manufacture of integrated circuits will be adapted and used.

Figure 1:
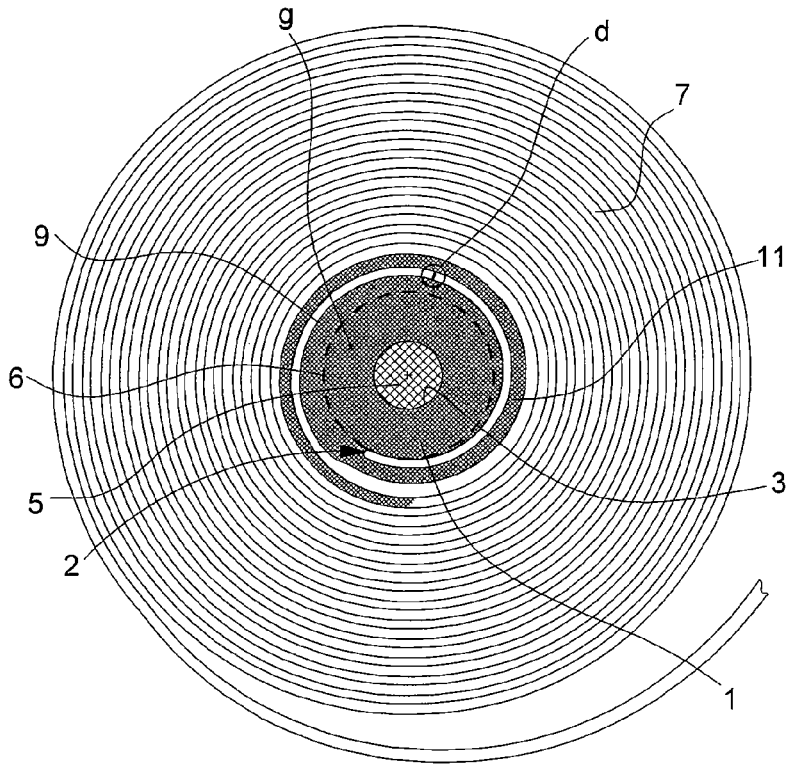
FIG. 1 shows a first embodiment.

FIG. 1 shows a first embodiment of a collet made in a single piece at the same time as the balance-spring 7, i.e. without any discontinuity of material at the junction region or join 2 between plate 1 of the collet and the first coil 11 of the inner terminal curve. Plate 1 includes an aperture 3 for securing the collet to the balance staff 5.

The circle 6, centred on balance staff 5 and passing through join 2, has been shown in dotted lines. As can be seen, the contour 9 of the collet is further and further removed from circle 6 in the direction of winding of the coils, to join 2.

Indeed, contour 9 follows at a substantially constant distance d the inner contour of first coil 11, i.e. the coil that starts from join 2 and makes a complete revolution to return to the same level radially as said join 2.

Thus, when a violent shock causes a large travel of the balance-spring, this construction limits the extent of the travel, since first coil 11 abuts against contour 9.

Figure 2:
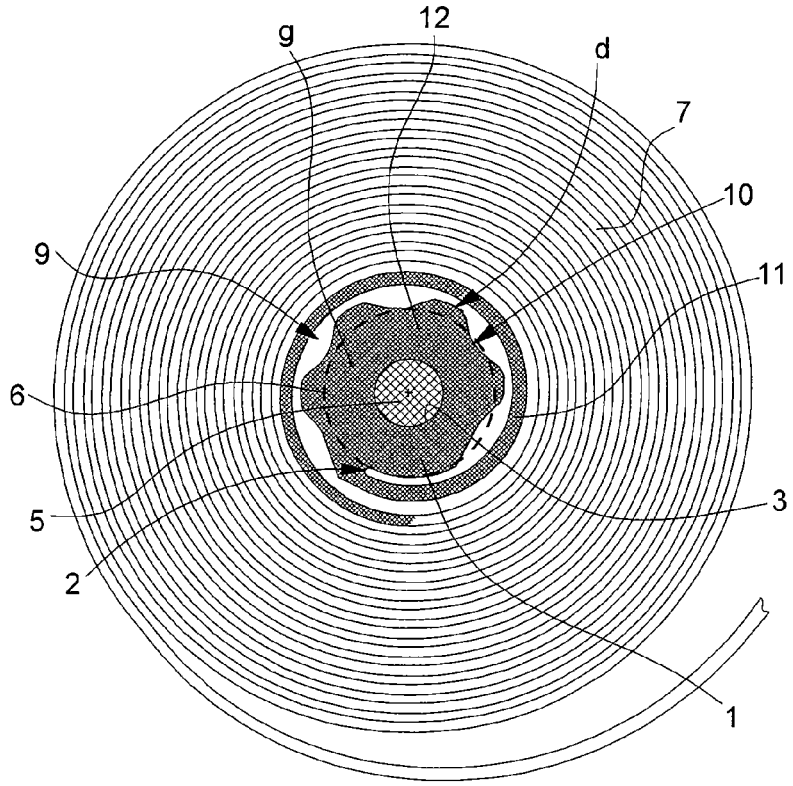
FIG. 2 shows a second embodiment.

According to another embodiment shown in FIG. 2, it can be seen that the contour of the collet is not continuous and has a scalloped shape with a succession of hollows 10 and teeth 12 whose ends are at distance d from first coil 11. In order to achieve the object of the invention, there need only be a discrete number of points located at distance d on the contour of the collet.

When the plate 1 forming the collet is solid, with the exception of the driving in aperture 3, it is clear that the centre of gravity g of the collet-balance-spring assembly cannot coincide with the centre of rotation of the balance staff 5, which has an unfavourable effect on the isochronism of the sprung balance regulating system.

Figure 3:
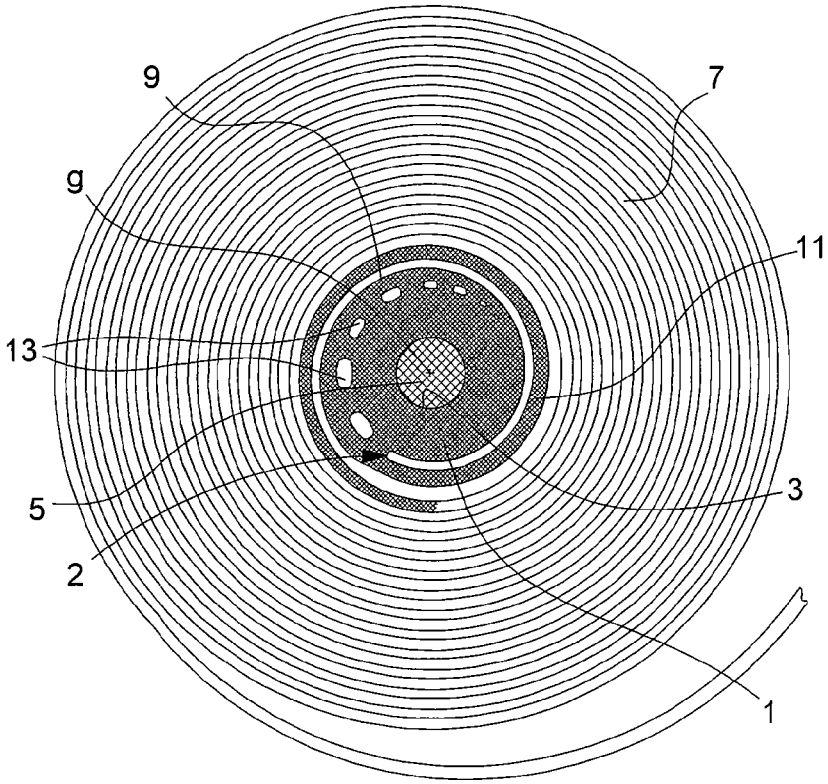
FIG. 3 shows a third embodiment.

FIG. 3 shows how it is possible to remove the aforementioned drawback. It can be seen that the centre of gravity g can be repositioned on balance staff 5 by forming, in the collet plate 1, recesses 13 whose surfaces decrease in the opposite direction to the direction of winding of the coils. According to another embodiment that is not shown, these recesses 13 can also be contiguous. The distribution and the surfaces of these recesses can be obtained by calculations within the grasp of those skilled in the art, once the shape of the collet and the place at which one wishes to have the centre of gravity of the collet or the collet-balance-spring assembly have been defined.

Figure 4:
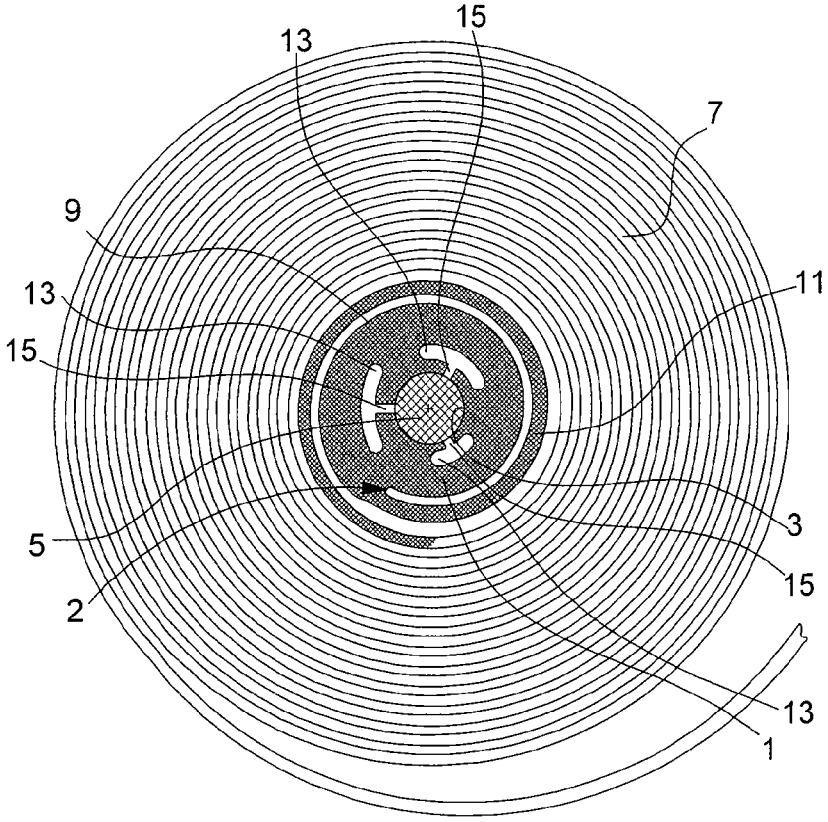
FIG. 4 shows a fourth embodiment.

FIG. 4 shows a third embodiment, which differs from the preceding embodiment in that the recesses 13 communicate via through passages 15 with aperture 3, the recesses and passage still being distributed so as to re-centre the centre of gravity of the collet-balance-spring assembly on balance staff 5. This construction also has the advantage of giving the driving in aperture some resilience, which is particularly useful when the material used to make the collet-balance-spring assembly is a brittle material, such as glass, quartz or silicon.

According to another embodiment that is not shown, when the collet has a scalloped contour, it is possible to reposition the centre of gravity g of the collet or the collet-balance-spring assembly on the balance staff by gradually increasing the depth of hollows 12 between teeth 10 as one moves away from the join 2 between the balance-spring and the collet.

Other embodiments within the grasp of those skilled in the art can be envisaged without departing from the scope of the present invention.

The invention claimed is:

1. An anti-shock collet connected to a balance spring of a sprung balance regulating system, wherein the anti-shock collet comprises:

a plate including an aperture formed therein for attachment to a balance staff of the sprung balance regulating system of a mechanical timepiece movement, wherein the sprung balance regulating system comprises the balance spring that includes a first coil that has an inner terminal curve, and the collet is made of a brittle and shock-sensitive material at the same time as the balance spring so there is no discontinuity of the material between the plate of the collet and the balance spring at a junction region connecting the plate of the collet and the balance spring as a single piece, wherein the collet has an asymmetrical contour that follows from the junction region, at which the collet joins the balance spring, to at least from place to place along a contour of the inner terminal curve of the first coil of the balance spring, and at a substantially constant distance d from the contour of the inner terminal curve of the first coil of the balance spring.

2. The collet according to claim 1, wherein the contour of the collet is a continuous curve.

3. The collet according to claim 1, wherein the material is selected from the group consisting of glass, quartz and silicon.

4. The collet according to claim 1, wherein the plate forming the collet includes recesses, wherein surfaces and distribution of the recesses are chosen to reposition a center of gravity of the collet, or of the collet-balance-spring assembly, on the balance staff of the sprung balance regulating system.

5. The collet according to claim 4, wherein the recesses are extended by passages communicating with a driving in passage for attachment to the balance staff.

6. A mechanical timepiece movement comprising a sprung balance regulating system that includes an anti-shock collet connected to a balance spring, wherein the anti-shock collet comprises:

a plate including an aperture formed therein for attachment to a balance staff of the sprung balance regulating system of a mechanical timepiece movement, wherein the sprung balance regulating system comprises the balance spring that includes a first coil that has an inner terminal curve, and the collet is made of a brittle and shock-sensitive material at the same time as the balance spring so there is no discontinuity of the material between the plate of the collet and the balance spring at a junction region connecting the plate of the collet and the balance spring as a single piece, wherein the collet has an asymmetrical contour that follows from the junction region, at which the collet joins the balance spring, along a contour of the inner terminal curve of the first coil of the balance spring, and at a substantially constant distance d from the contour of the inner terminal curve of the first coil of the balance spring.

7. An anti-shock collet connected to a balance spring of a sprung balance regulating system, wherein the anti-shock collet comprises:

a plate including an aperture formed therein for attachment to a balance staff of the sprung balance regulating system of a mechanical timepiece movement, wherein the sprung balance regulating system comprises the balance spring that includes a first coil that has an inner terminal curve, and the collet is made of a brittle and shock-sensitive material at the same time as the balance spring so there is no discontinuity of the material between the plate of the collet and the balance spring at a junction region connecting the plate of the collet and the balance spring as a single piece, wherein the collet has an asymmetrical contour that follows from the junction region, at which the collet joins the balance spring, along a contour of the inner terminal curve of the first coil of the balance spring, wherein the contour of the collet is a scalloped curve having a succession of hollows and teeth, wherein ends of the teeth are at the substantially constant distance d from the inner terminal curve of the first coil.

8. The collet according to claim 7, wherein a depth of the hollows between the teeth increases progressively as one moves away from the junction region located between the collet and the balance spring.

9. A mechanical timepiece movement comprising a sprung balance regulating system that includes an anti-shock collet connected to a balance spring, wherein the anti-shock collet comprises:

a plate including an aperture formed therein for attachment to a balance staff of the sprung balance regulating system of a mechanical timepiece movement, wherein the sprung balance regulating system comprises the balance spring that includes a first coil that has an inner terminal curve, and the collet is made of a brittle and shock-sensitive material at the same time as the balance spring so there is no discontinuity of the material between the plate of the collet and the balance spring at a junction region connecting the plate of the collet and the balance spring as a single piece, wherein the collet has an asymmetrical contour that follows from the junction region, at which the collet joins the balance spring, along a contour of the inner terminal curve of the first coil of the balance spring, wherein the contour of the collet is a scalloped curve having a succession of hollows and teeth, wherein ends of the teeth are at the substantially constant distance d from the inner terminal curve of the first coil.

* * * * *